United States Patent [19]

Svedberg-Reker et al.

[11] 4,222,139

[45] Sep. 16, 1980

[54] FASTENING OF MATTRESS PADS AND THE LIKE

[76] Inventors: Laura J. Svedberg-Reker; Jay J. Reker, both of 7545 Pleasantview Dr., Moundsview, Minn. 55432

[21] Appl. No.: 34,631

[22] Filed: Apr. 30, 1979

[51] Int. Cl.[3] ..... A47C 27/08

[52] U.S. Cl. ..... 5/498; 5/402; 5/460

[58] Field of Search ..... 5/400, 402, 451, 470, 5/473, 496, 498, 499, 504, 460

[56] References Cited

U.S. PATENT DOCUMENTS

| | | | |
|---|---|---|---|
| 2,450,923 | 10/1948 | Sapiro, Jr. | 5/499 |
| 2,923,014 | 2/1960 | Hume | 5/498 |
| 3,092,848 | 6/1963 | Gronvold | 5/498 |
| 4,015,299 | 4/1977 | Tinnel | 5/451 |
| 4,145,781 | 3/1979 | Autrey et al. | 5/402 |

*Primary Examiner*—Casmir A. Nunberg

*Attorney, Agent, or Firm*—Schroeder, Siegfried, Ryan, Vidas, Steffey & Arrett

[57] ABSTRACT

A harness-like arrangement for securing mattress pads and the like to the top of mattresses.

18 Claims, 4 Drawing Figures

FASTENING OF MATTRESS PADS AND THE LIKE

I. DESCRIPTION

Background of Prior Art

This invention relates in general to mattress covering arrangements and more specifically to such arrangements comprising improved means for fastening mattress pads to the tops of mattresses. The invention is particularly suitable for use with waterbeds.

Generally, waterbeds include a waterbed frame, waterbed liner, and waterbed mattress. The purpose of the waterbed liner is to serve as an emergency container for holding water should the waterbed mattress leak.

Securing mattress pads and the like to waterbed mattresses is difficult due to the shifting of the waterbed mattress in use. It has been found that standard fitted mattress pads tend to work loose at the corners and along the sides causing the sheets to also come loose from the mattress.

It is a purpose of this invention to provide an improved means for securing mattress pads to mattresses and particularly to waterbed mattresses.

BRIEF SUMMARY OF THE INVENTION

In its broader aspects, the invention includes several bands, preferably elastic, which are placed between the waterbed liner and the mattress before it is filled. The bands extend upwardly along the sides of the mattress to the top surface thereof. After the mattress is filled, corresponding snap-fastener elements or the like on the pad and the bands are interconnected to secure the pad to the top of the mattress.

Several advantages are attendant to such an arrangement. For example, the mattress pad can be conveniently snapped on and off for laundering. The pad edges do not tend to ride up and off the mattress as with conventional mattress pads. The preferred elastic bands flex to more readily accomodate various water amounts and shifts in the water content of the mattress.

DETAILED DESCRIPTION OF INVENTION

Figure 1:
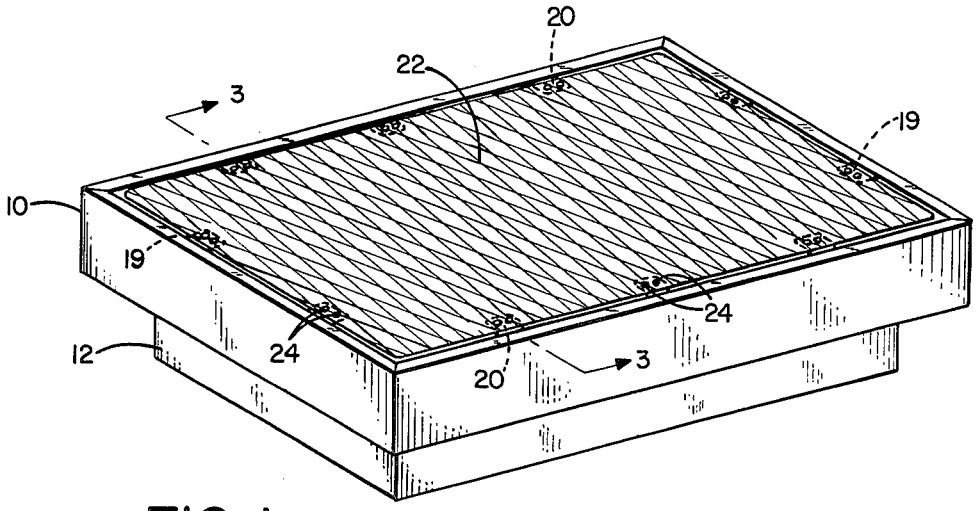
FIG. 1 is a perspective view showing a waterbed in somewhat schematic form, the bed having a mattress pad secured to the water containing mattress in accordance with the invention.

The waterbed shown in the figures includes a frame 10 supported on a pedestal 12. Contained within frame 10 is a waterbed liner 14 (best seen in FIG. 3) which in turn contains a waterbed mattress 16 (also best seen in FIG. 3) and the harness-like arrangement 18 of the invention (best seen in FIG. 2).

Figure 2:
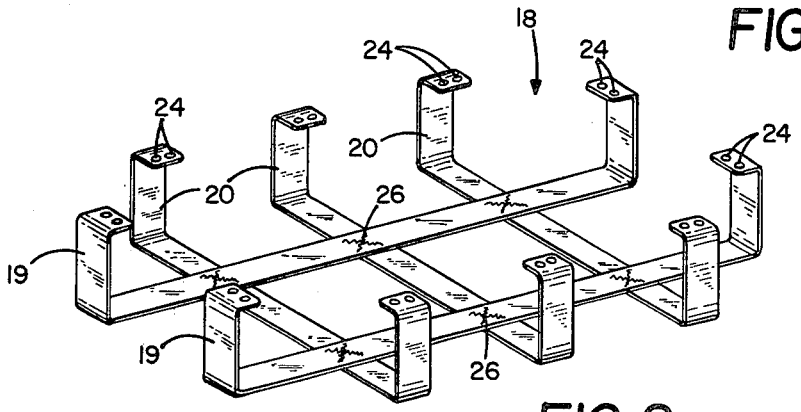
FIG. 2 is a perspective view of a preferred harness-like arrangement for elastic bands according to the invention.
Figure 3:
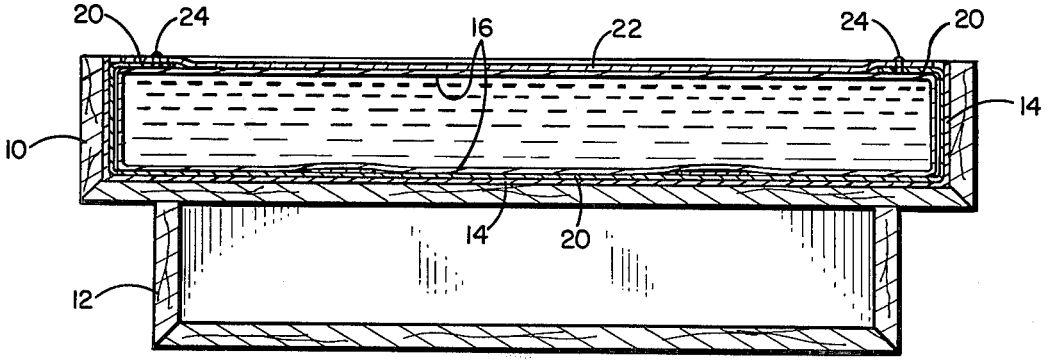
FIG. 3 is a cross-sectional view taken along lines 3—3 of FIG. 1.

In the preferred embodiment shown in FIG. 2, the harness-like arrangement 18 comprises a network of a plurality of elastic bands 19 and 20 which are placed between waterbed liner 14 and mattress 16 before the mattress is filled. After the mattress is filled, a mattress pad 22 is placed on top of the mattress as shown in FIG. 1. The mattress pad 22 includes spaced fastening elements arranged about the periphery thereof which are attached to corresponding fastening elements 24 carried at the ends of bands 19 and 20.

As can be seen from the figures, the bands are arranged in spaced fashion longitudinally (bands 19) and transversely (bands 20) of the mattress and are of such a length as to extend upwardly to the top of the mattress for connection to mattress pad 22. Preferably, as shown in FIG. 1, the bands will be positioned underneath pad 22 and will terminate as near the edge of the mattress as possible. Their length is exaggerated in the figure for pictorial purposes.

Preferably, the bands will be made of elastic material of the type commonly found in fabric stores. Two inch width elastic bands used in a network of two longitudinal and three transverse bands have been found to be satisfactory in accordance with the invention. However, bands of webbing or the like may be used which are elastic only in part such as at the ends or at central sections along the lengths thereof. Ordinary inelastic webbing or other band materials may also be used.

Figure 4:
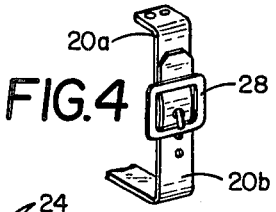
FIG. 4 is a showing of an adjustable band.

As shown in FIG. 2, bands 19 and 20 are preferably stitched together at their intersections 26 to form a harness-like arrangement. Alternatively, the bands may be secured to a central portion of webbing or other means to be placed generally centrally of the mattress and underneath it (not shown). However, it is not necessary that the bands be interconnected at all. They may be used separately. Also, as indicated in FIG. 4, the bands may be adjustable as to length by incorporating suitable adjustment means such as a buckle 28 or the like with the bands at various selected locations.

Preferably, heavy-duty snaps or snap fasteners 24 are used to attach the mattress pad to the elastic bands. "Gripper", "Clinton" and "Dritz" #15 and #16 snap fasteners made by the Scovill Company of Spartanburg, S. C. 29304 have been used satisfactorily. Preferably, the male portion of the snap will be carried by the band and the female portion by the pad. However, other fastening means may be utilized in place of snaps or snap fasteners. Hook fasteners, buttons, "Velcro" fastening material and the like may be used.

Mattress pad 22 may be of the usual quilted fabric type, rubberized material, plastic film, or the protective material or a combination of appropriate materials. Preferably, the pad is a flat pad adapted to be laid flat on the upper surface of the mattress.

The materials, dimensions and geometric forms of the various elements of this invention are subject to numerous variations and modifications as will readily be apparent to those skilled in the art.

Having described the preferred embodiment of the invention, the exclusive rights claimed are defined hereinbelow.

1. A harness for attaching mattress pads and the like to a waterbed mattress, the harness comprising a plurality of elongated retaining bands; means fastening the bands together in a longitudinal and transverse network arrangement for placement under a waterbed mattress, the bands being spacedly arranged relative to each other and of such a length as to extend from underneath the mattress to the upper surface thereof at spaced locations along all four sides thereof to afford contact between the extending ends of the bands and a mattress pad or the like placed on the mattress top, and means carried by each of the bands at the extending ends thereof for releasably attaching the bands to the pad or the like whereby the pad is releasably held in a predetermined position on the mattress top.

2. The harness of claim 1 wherein at least portions of the bands are elastic.

3. The harness of claim 1 wherein the bands are adjustable in length.

4. The harness of claim 1 wherein the attachment means on the ends of the bands comprises snap fastening elements.

5. The harness of claim 1 wherein the bands are elastic.

6. The harness of claim 1 wherein the network includes three spaced transverse retaining bands and two spaced longitudinal retaining bands.

7. The harness of claim 1 wherein the retaining bands are elastic, the network includes at least two transverse retaining bands and at least two longitudinal retaining bands, and each of the bands is of such a length as to extend to the upper surface of a mattress under which the harness is placed.

8. The harness of claim 7 wherein the attachment means on the ends of the retaining bands comprise snap fastening elements.

9. The harness of claim 8 wherein the bands are positioned under the pad.

10. The harness of claim 1 wherein the bands are adapted for being carried under the pad.

11. The harness of claim 9 wherein the harness includes at least three transverse retaining bands.

12. In combination for a waterbed, a mattress pad or the like and a harness for positioning and retaining the pad on a waterbed mattress, the harness comprising a plurality of elongated retaining bands; means fastening the bands together in a longitudinal and transverse network arrangement for placement under the waterbed mattress, the bands being spacedly arranged relative to each other and of such a length as to extend from underneath the mattress to the upper surface thereof at spaced locations along all four sides of the mattress for connection to the mattress pad; releasable connection means on the bands, and spaced cooperating connection means affixed to the pad for connection to the band connection means, respectively.

13. The combination of claim 12 wherein the bands are elastic at least in part.

14. The combination of claim 12 wherein there are at least two longitudinal bands and at least three transverse bands.

15. The combination of claim 12 with a waterbed wherein the mattress is a waterbag.

16. The combination of claim 15 wherein the harness network includes at least two longitudinal bands and at least three transverse bands, the mattress pad and extending ends of the retaining bands including cooperating fastening elements for attaching the pad to the bands thereby releasably positioning same on the mattress.

17. The combination of claim 15 wherein the bands are positioned under the pad.

18. The combination of claim 17 wherein the connection means between the bands and mattresss pad comprise mating snap fasteners.

* * * * *